United States Patent [19]

Gorbulsky

[11] 4,449,461

[45] May 22, 1984

[54] PROCESS AND APPARATUS FOR HYDROCARBONS RECOVERY FROM SOLID FUELS

[76] Inventor: Jacob Gorbulsky, 128 Milton Ave., Ballston Spa, N.Y. 12020

[21] Appl. No.: 367,554

[22] Filed: Nov. 10, 1981

[51] Int. Cl.[3] ..... F23D 1/00

[52] U.S. Cl. ..... 110/229; 48/77; 110/230; 110/347

[58] Field of Search ..... 110/229, 230, 347; 48/101, 209, 77, 210; 44/1 R

[56] References Cited

U.S. PATENT DOCUMENTS

| | | | |
|---|---|---|---|
| 2,557,680 | 6/1951 | Odell . | |
| 2,676,908 | 4/1954 | Noel . | |
| 2,741,549 | 4/1956 | Russell . | |
| 3,733,183 | 5/1973 | Singh . | |
| 3,841,991 | 10/1974 | Cohen . | |
| 4,344,373 | 8/1982 | Ishii et al. | 110/229 X |

OTHER PUBLICATIONS

*Lurgi–Ruhrgas Retorting Process,* Synthetic Fuels Data Handbook, Cameron Engineers Inc., 1978, pp. 81–88.

*Tosco II Process,* Synthetic Fuels Data Handbook, Cameron Engineers Inc., 1978, pp. 81–88.

*Primary Examiner*—Edward G. Favors

*Attorney, Agent, or Firm*—Timothy R. Kroboth

[57] ABSTRACT

Inexpensive process for synthetic fuel production, contained fluidized-bed burner, pyrolysis reactor with layer of fuel & hot material mixture and hot material circulation system.

Fuel is heating up to pyrolysis temperature by surrounded hot material in layer. Volatile matter, evacuated from pyrolyser to cooler, is used for synthetic fuel production. Warm mixture of char and bed material is returned to fluidized bed for burning. Heat of burned char used for circulated material heat up and for steam generation. Hot material from fluidized bed is transported to pyrolyser and, after mixing with fuel form layer in pyrolyser.

The process may be used for utilization of extremely wide range of fuels. For fuels with low value of fixed carbon content, oil shale for example, the process may be used solely for synthetic fuel production; for coals only part of fuel energy may be transfer to synthetic fuel, rest have to be used for steam generation. Being used as fuel preparation plant for fluidized-bed steam boiler, the process also dramatically improve its parameters.

7 Claims, 1 Drawing Figure

PROCESS AND APPARATUS FOR HYDROCARBONS RECOVERY FROM SOLID FUELS

FIELD OF INVENTION

The invention relates to synthetic fuel production from solid fuels by pyrolysis processes during direct contact between fuel and hot material particles.

DISCUSSION OF PRIOR ART

Heretofore two processes have been used for the same purposes: Lurgi-Ruhrgas and TOSCO II retorting processes.

In Lurgi-Ruhrgas retorting process raw fuel is mixed with hot ash in a screw type retort, heated and pyrolysed. Vaporised products of pyrolysis is raw material for synthetic fuel. Warm mixture of ash with carbon residue is going to lift pipe burner for carbon residue burning and for ash heating up. Hot ash after gas/solids separation can be mixed with new portion of raw material. The process is requied high temperature gas/solids separation, which is hardly applicable for an industry, especially becouse of lift pipe burner is required fine particles. Also screw type retort can not be used effectively for large capasity.

In TOSCO II retorting process hot ceramic balls are used for raw fuel heat up. The process is required a special heater for balls, which needed some product burning. Balls and raw material are mixing together in a special pyrolysis drum and, after separation from ash, balls lift up to the ball heater. The process is not effective enough becouse of carbon residue can't be used and some product burning is required.

OBJECTS

The invented process have no described above disadvantages. Hot material, needed for pyrolysis, is taken from fluidized-bed burner, which is much more effective, that ball heater in TOSCO II, utilize carbon residue and, in opposite to Lurgi-Ruhrgas process, don't needed special gas/solids separation system.

Also as against to other similar systems, mixture of hot material and raw fuel in pyrolyser is forming during feeding and don't needed any special system for additional mixing, for example a special device like mixing screw in Lurgi-Ruhrgas process or fluidization.

The mixing may be organized by feeding of both streams in same place of pyrolyser and/or by using other devices, refraction panels for example. Main difference is in a fact, that mixing process is made before layer is formed. Layer in pyrolyser is thick enough to have mixture residence time big enough for temperature relaxation.

Some advantages of this process:

1. The system is extremely simple and inexpensive.
2. An extremely wide range of fuels may be used.
3. The system does not required fine fuel particles.
4. Gas/solids separation of circulated material don't needed.
5. The system may be used as fuel preparation plant for fluidized-bed boiler. Becouse of volatile matter and sulphur in the process are separated from fuel before burning it give some advantages for improving boiler characteristics.
6. Power stations, employed fluidized-bed boilers with invented process, can produce synthetic fuel also.

Further objects and advantages of my invention will become apparent from a consideration of the drawings and ensuing description thereof.

DRAWINGS

The invention will be more fully described with reference to the accompanying drawings.

DESCRIPTION AND OPERATION

Figure 1:
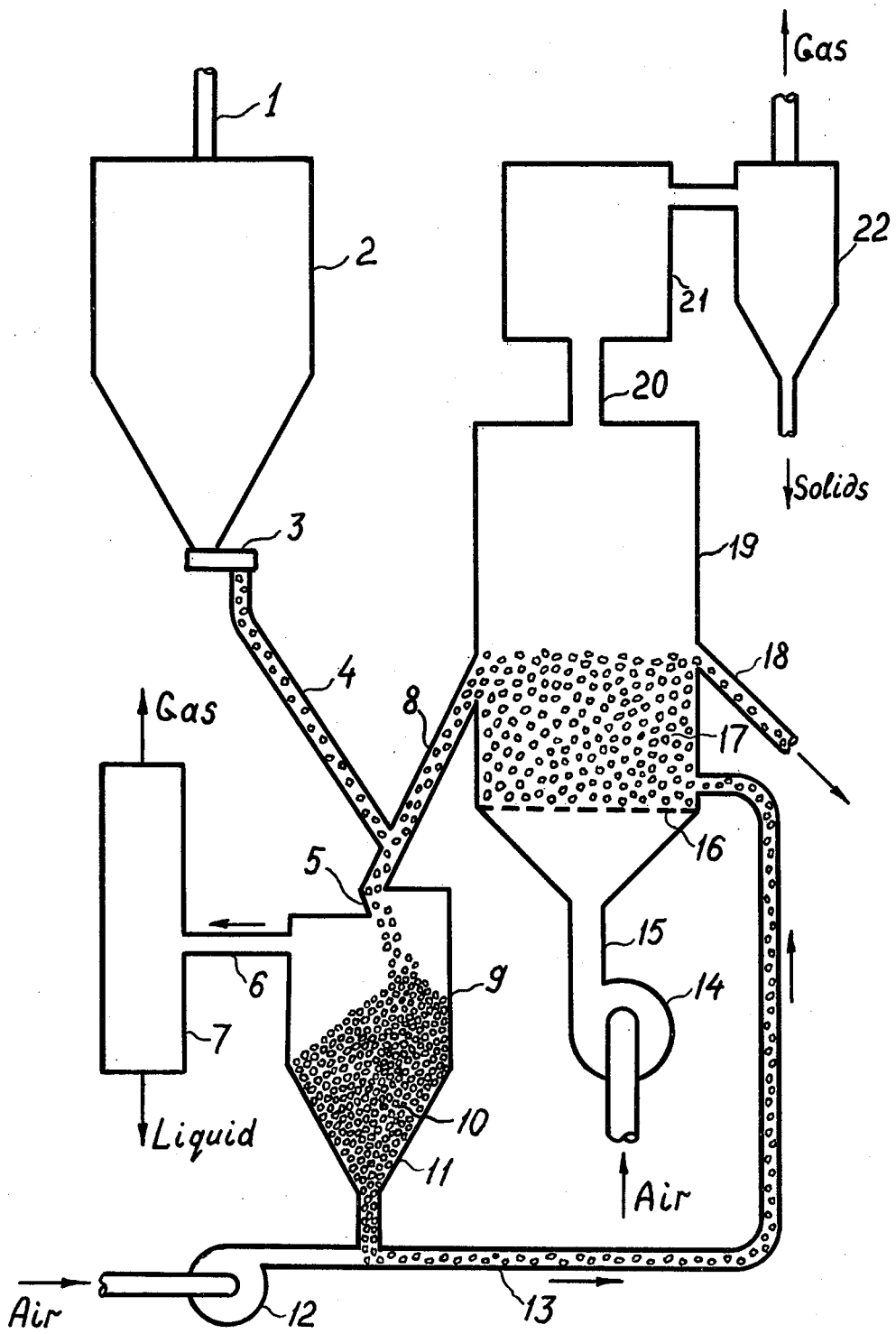
FIG. 1 is an illustration of the process, suitable mainly for fuels with low fixed carbon content.

For fuels with low fixed carbon content (FIG. 1), oil shale for example, main elements of the system are fluidized-bed burner (19) and pyrolyser (9), connected by hot material circulation line which included conduit (8) and pneumo transportation system (13). The process also included: raw fuel system which included hopper (2), feeder (3) and conduit (4); oil condenser (7) to condense products of pyrolysis flowing from pyrolyser; stack gas cooling and cleaning system which contained waste-heat boiler (21) and cyclones (22).

Fluidized-bed burner (19) is similar to fluidized-bed reactors, being used in chemical industry. Sulphur ore fluidized-bed burner employed in sulfuric acid industry is a good example of this burners. Sulphur ore fluidized-bed burners can be used for the process almoust without modification.

Fluidized-bed burner (19) is a reactor with heat resistance walls and distribution means (16) at the bottom. Fluidized bed (17) is maintained by air passed through distribution means. Discharge systems for superfluous material and for circulated material ae similar to discharge systems for fluidized-bed chemical reactors. For particular process on FIG. 1 gravity discharge systems are employed. They may be made as conduits, connected to wall holes on or below bed level, so bed material can flow downward. They may also have additional valves for flow regulation.

Pyrolyser (9) is, in a simpliest case, a tank with heat resistance walls and discharge hopper (11) at the bottom. Hot material and raw fuel are introduced in upper part of pyrolyser. They may be introduced together through same conduit or by different lines, but before or during layer generation they have to be mixed. Some special devices for it may be installated for better results but they are not necessary. In simpliest case pyrolyser is an empty tank with heat resistance walls and hopper at the bottom. Solids flow from hopper (11) is regulated by transportation system (13) in way to keep layer (10) thick enough to maintain mixture residence time big enough for temperature relaxation between hot material and fuel particles. Layer depth may be kept for most cases equal 3–4 ft.

Layer depth may be also regulated by regulation of mass of material in whole system, in particular by fluidized-bed discharge system (18), which in this case have to be put lower, that bed level and have to have flow regulator; circulation discharge hole in this case will be on the bed level.

Refering to FIG. 1 raw fuel from preparation plant or storage is introduced into the system through line (1) and fed through hopper (2), feeder (3) and conduit (4) into conduit (8). Hot material from fluidized bed (17) is flow downward through same conduit (8). Hot material & raw fuel stream from conduit (8) is refract from refpaction wall (5) for better mixing and fall down to the layer (10). Pyrolysis gases, generated by fuel pyrolysis during its heat up by hot surrounded material, leaving pyrolyser through conduit (6) to oil condenser (7), which is condence condensable part of product and cool gaseous part.

Warm mixture from discharge hopper (11) is transported by air, driven by fan (12) through pneumo transportation system (13) into fluidized bed (17). Carbon residue is burned and generated heat, needed for the process. Some additional fuel and/or some product may be introduced into the bed for additional heat release. Also additional fuel can be added to raw fuel.

Air for bed fluidization and carbon residue burning is introduced by fan (14) through conduit (15) and distribution means (16). Products of burning flow through conduit (20) to waste-heat boiler (21) for cooling and after solids separation by cyclone (22) leave the system.

For fuels with high fixed carbon content smaller part of energy of fuel may be transferred to synthetic fuel. Rest may be used for steam generation by fluidized-bed steam boilers.

Becouse of substantially high part of energy is used for steam generation and becouse of the system may improve fuel quality—decrease sulphur content, extract moisture and volatile matter—the system may be employed like fuel preparation plant, which however will also produce synthetic fuel.

Figure 2:
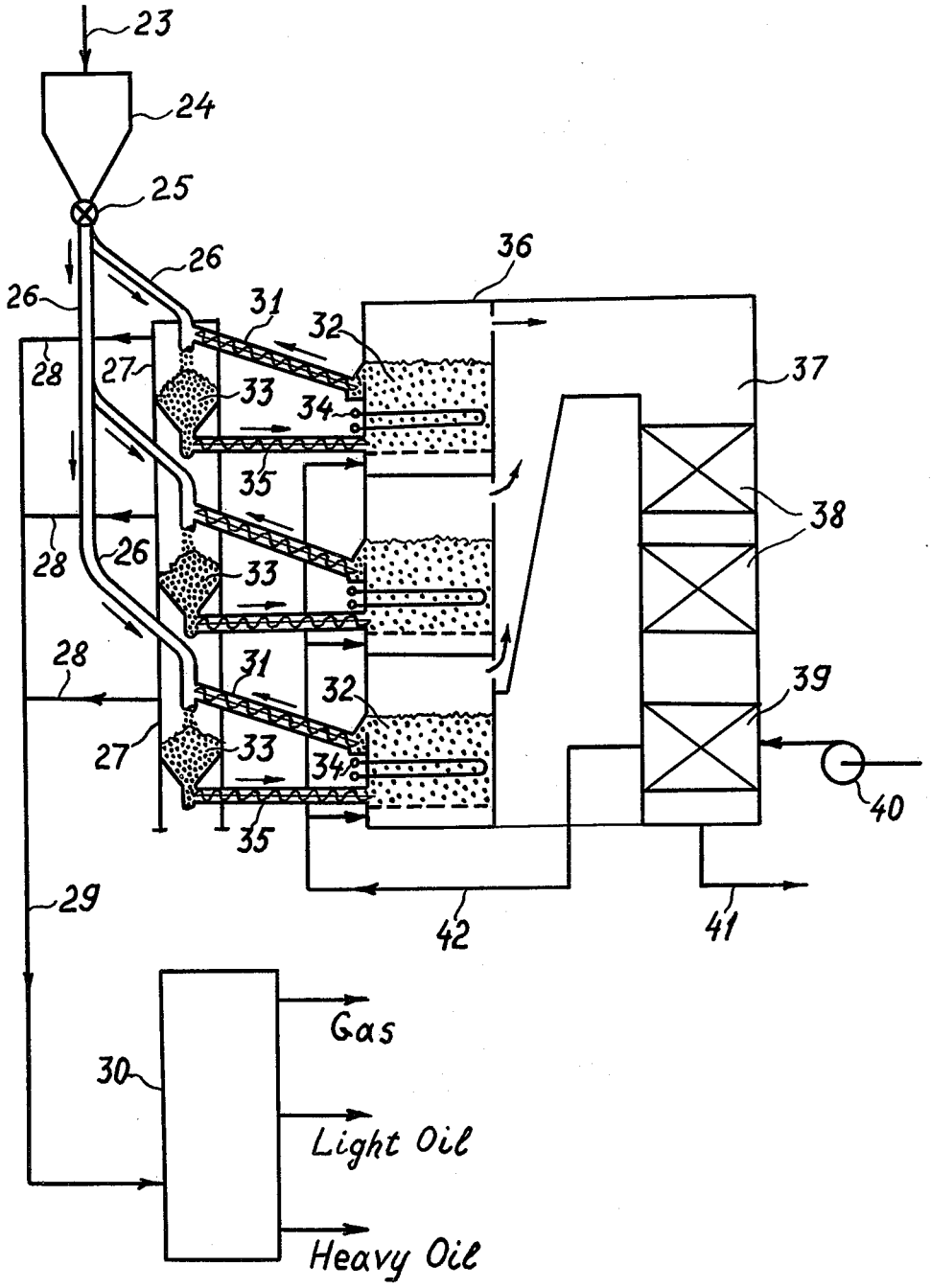
FIG. 2 is an illustration of the process, being used like fuel preparation plant for fluidized-bed boiler. Suitable mainly for fuels with high fixed carbon content.

FIG. 2 is an illustration of the process, which is similar to described by FIG. 1. Fluidized-bed boiler (36) is employed instead of fluidized-bed burner. Multibed boiler, used for illustration, is not required for the process. Both mono- and multibed systems may be used for fuels with low and high value of fixed carbon content. Any kind of fluidized-bed boiler may be employed, but heat absorbtion in the fluidized bed have to be decreased to maintain fluidized bed heat balance in despite of transmit heat to pyrolyser.

Pyrolyser (27) on FIG. 2 is consist from 3 sections. Each section is similar to the pyrolyser, described for process for fuels with low fixed carbon content (9 on FIG. 1). Each section is placed to cooperate with its own fluidized bed, so fluidized bed-pyrolyser connection is similar to one, described by FIG. 1. Constractions with single layer pyrolyser for multibed boiler or multilayer pyrolyser with single bed boiler and so on also may be used.

Refering to FIG. 2 raw fuel from preparation plant or storage is introduced into the system through line (23), fed through hopper (24) and by feeders (25) through conduits (26) introduced nto pyrolyser sections (27).

Hot material from fluidized beds (32) by screw feeders (31) is introduced into conduits (26) and, together with raw fuel flowing through same conduit, falling down to the layer (33). Pyrolysis gases, yealded by fuel, leave pyrolyser through conduits (28), collect in conduit (29) and flow to oil condenser (30), which condence condensable part of product and cool gaseous.

Warm mixture from layers (33) is transported by screw feeders (35) into the fluidized beds (32) to burn burnable part of mixture.

Gas streams in the boiler are common for fluidized-bed boilers. Cold air from fan (40) flow through air heater (39) and by conduit (42) distributed to the fluidized beds for fluidization and burning. Heat generated in the beds by char burning partly leave beds with hot circulated material and used for pyrolysis, partly picked up by in-bed tubes (34) and used for steam generation. Hot gases leaved fluidized beds are collected in the convective pass (37), cooled by convective surfaces (38) and airheater (39) and by conduit (41) leave the system.

The system on FIG. 2 may be also described as kind of fluidized-bed boiler, in which fuel is introduced into fluidized bed in mixture with hot material. Hot material is taken from fluidized bed and mixing with fuel in a way, which permit evacuate volatile matter and mousture, yealded by fuel before fuel is introduced to fluidized bed for combustion. Pyrolysis reactor (27) in this case may be described as part of fluidized-bed boiler, but this change is not affected process itself, so illustration on FIG. 2 may be also applied for this description.

While the above descriptions contains many specifities, these should not be construed as limitations on the scope of the invention, but rather as an exemplification of preferred embodiment thereof. Many other variations are possible, for example layer and fluidized bed may be placed in same constraction volume, divided by wall to fluidized-bed section and pyrolysis section with holes in the wall for material circulation, which may be natural or forced. Accordingly, the scope of the invention should be determined not by the embodiment illustrated, but by the appended claims and their legal equivalents.

I claim:

1. Apparatus for volatile matter recovery from solid fuels comprising:
   (a) a fluidized-bed combustor for burning pyrolyzed solid fuel, and
   (b) a fixed bed pyrolyzer in a connecting relationship with the combustor for receiving hot material from the combustor for heating fresh solid fuel, the pyrolyzer further having an outlet that communicates with the combustor for transporting the pyrolyzed solid fuel to the combustor, and also having an outlet for volatile matter discharge.

2. Apparatus of claim 1 wherein the conduit providing the connecting relationship between the combustor and the pyrolyzer is in a connecting relationship with a hopper, for mixing the fresh solid fuel with the hot material prior to introducing the fuel into the pyrolyzer.

3. Process for synthetic fuel production from a solid fuel comprising
   (a) mixing fresh solid fuel with hot material from a fluidized-bed combustor,
   (b) pyrolyzing the resulting mixture in a fixed bed pyrolyzer to produce synthetic fuel,
   (c) transporting the resulting mixture of solids from the pyrolyzer to the combustor, and
   (d) burning in the combustor the organic material in the transported mixture to form the hot material.

4. Apparatus for steam generation from a solid fuel comprising
   (a) a fluidized-bed steam boiler, and
   (b) a fixed bed pyrolyzer for removing volatile matter from fresh solid fuel, the pyrolyzer being in a connecting relationship with the boiler for receiving hot material from the boiler for heating the fresh solid fuel, and the pyrolyzer further having an outlet that communicates with the combustor for transporting the volatile matter-free solid fuel to the boiler.

5. The apparatus of claim 4, wherein the conduit providing the connecting relationship between the boiler and the pyrolyzer is in a connecting relationship with a hopper, for mixing the fresh solid fuel with the hot material prior to introducing the fuel into the pyrolyzer.

6. The apparatus of claim 4, wherein the boiler is a multi-bed boiler.

7. The process of claim 3, wherein the fresh solid fuel is mixed with the hot material prior to introducing the fresh solid fuel into the pyrolyzer.

* * * * *